US006030165A

United States Patent [19]

Ishida

[11] Patent Number: 6,030,165

[45] Date of Patent: Feb. 29, 2000

[54] BOOK BINDING MACHINE

[75] Inventor: Katsunori Ishida, Minami, Japan

[73] Assignee: Horizon International Inc., Shiga, Japan

[21] Appl. No.: 09/002,603

[22] Filed: Jan. 5, 1998

[30] Foreign Application Priority Data

Jan. 28, 1997 [JP] Japan ..... 9-050834

[51] Int. Cl.[7] ..... B42B 2/00

[52] U.S. Cl. ..... 412/35; 412/20; 412/28; 412/32; 412/33

[58] Field of Search ..... 412/20, 28, 32, 412/33, 35

[56] References Cited

U.S. PATENT DOCUMENTS

| | | | |
|---|---|---|---|
| 1,972,672 | 9/1934 | Alger | 412/35 |
| 2,024,959 | 12/1935 | Alger | 412/35 |
| 5,518,228 | 5/1996 | Bodie et al. | 270/53 |
| 5,569,012 | 10/1996 | Kosasa et al. | 412/33 |
| 5,621,769 | 11/1993 | Leclerc | 412/20 |
| 5,678,813 | 10/1997 | Osako et al. | 412/35 |
| 5,702,219 | 12/1997 | Hattori | 412/33 |

FOREIGN PATENT DOCUMENTS 0 371 403 A2 6/1990 European Pat. Off. .

*Primary Examiner*—Andrea L. Pitts
*Assistant Examiner*—Monica Smith
*Attorney, Agent, or Firm*—Morgan & Finnegan, L.L.P.

[57] ABSTRACT

A sheet supply inlet (4) receives sheets (3) one by one from a printing machine (2). A sheet gathering and registering mechanism (20) comprises a pair of sheet feed rollers (24A, 24B) arranged in the neighborhood of the sheet supply inlet (4) for successively supplying each sheet (3) from the sheet supply inlet (4) to the sheet stitching station (5) so as to lay the sheets (3) one above another in the sheet stitching station (5), and a guide plate (26) arranged adjacent to the sheet feed rollers (24A, 24B) for swing movement in such a manner that the guide plate (26) pushes the rear end of the top sheet (3) toward the stopper (12; 13) until the front end of the top sheet (3) abuts against the stopper (12;13) each time the sheet is supplied to the sheet stitching station (5).

6 Claims, 2 Drawing Sheets

BOOK BINDING MACHINE

BACKGROUND OF THE INVENTION

This invention relates to a book binding machine, and more particularly to a book binding machine provided with a sheet gathering mechanism.

Some conventional book binding machines are designed to receive a set of gathered sheets from the other machine such as a printing machine and a copying machine (these machines are collectively referred as a "printing machine" in the following sentences.) and stitch the set of collated sheets along the center line thereof or along an end line thereof or at a corner thereof.

Such book binding machines requires a sheet gathering machine, when it is coupled to a printing machine adapted for ejecting sheets one by one in the order of page number.

The sheet gathering machine has been manufactured so far without considering that it is arranged between a book binding machine and a printing machine. Therefore, on installing the sheet gathering machine, it is necessary to adjust the position of the sheet gathering machine with respect to both the book binding machine and the printing machine, which leads to considerably troublesome work. In addition, the sheet gathering machine occupies a broad space for installation.

SUMMARY OF THE INVENTION

An object of the invention is, therefore, to provide a book binding machine capable of being directly coupled to a printing machine without lying a sheet gathering machine between the book binding machine and the printing machine.

According to the present invention, the object is accomplished by a book binding machine adapted for receiving sheets at a sheet supply inlet thereof, supplying the sheets from the sheet supply inlet to a sheet stitching station, positioning the sheets by a stopper disposed behind a stitching head in the sheet stitching station, stitching the sheets by the stitching head, and delivering the stitched sheets from the sheet stitching station, characterized in that sheets are supplied one by one to the sheet supply inlet and a sheet gathering and registering mechanism is arranged for successively supplying each sheet from the sheet supply inlet to the sheet stitching station so as to lay the sheets one above another in the sheet stitching station, and pushing the rear end of the top sheet toward the stopper until the front end of the top sheet abuts against the stopper each time the sheet is supplied to the sheet stitching station, whereby the gathered sheets are positioned with alignment of the front and rear ends thereof.

In accordance with a preferred embodiment, the sheet gathering and registering mechanism comprises a pair of sheet feed rollers arranged in the neighborhood of the sheet supply inlet for successively supplying each sheet from the sheet supply inlet to the sheet stitching station so as to lay the sheets one above another in the sheet stitching station, and a guide plate arranged adjacent to the sheet feed rollers for swing movement in such a manner that the guide plate pushes the rear end of the top sheet toward the stopper until the front end of the top sheet abuts against the stopper each time the sheet is supplied to the sheet stitching station.

In accordance with another preferred embodiment, the sheet gathering and registering mechanism further comprises a guide rod arranged along a sheet transport path extending from the sheet supply inlet into the sheet stitching station, an endless drive belt arranged in parallel with the guide rod, a motor for driving the drive belt, and a base plate fixed to the drive belt and movably mounted on the guide rod in such a manner that drive of the drive belt effects sliding movement of the base plate along the guide rod, the base plate being provided with the sheet feed rollers, a first motor for driving the sheet feed rollers, a second motor, a connecting link eccentrically coupled to the rotation axis of the second motor at its one end, and the guide plate connected to the other end of the connecting link, whereby drive of the second motor causes the guide plate to make swing motion.

Accordingly, the present invention is advantageous in that even though the printing machine is designed to eject sheets one by one in the order of page number, each sheet is successively received in the sheet supply inlet of the book binding machine and supplied to the sheet stitching station so as to be laid one above another in a space extending in the front of the stopper positioning a set of sheets to be stitched, and then the sheets are gathered with alignment of the front and rear ends thereof by abutting the front end of each of the sheets against the stopper and stitched together by the stitching head.

Furthermore, according to the present invention, since the sheet gathering and registering mechanism is built in the book binding machine, the book binding machine can be directly coupled to a printing machine without arranging a sheet gathering machine between the book binding machine and the printing machine, so that it is unnecessary to adjust the position of the sheet gathering machine with respect to both the book binding machine and the printing machine, and a space for installations and the manufacturing cost can be cut down.

The other objects and features of this invention will become understood from the following description with reference to the accompanying drawings.

DETAILED DESCRIPTION OF THE PREFERRED EMBODIMENT

Figure 1:
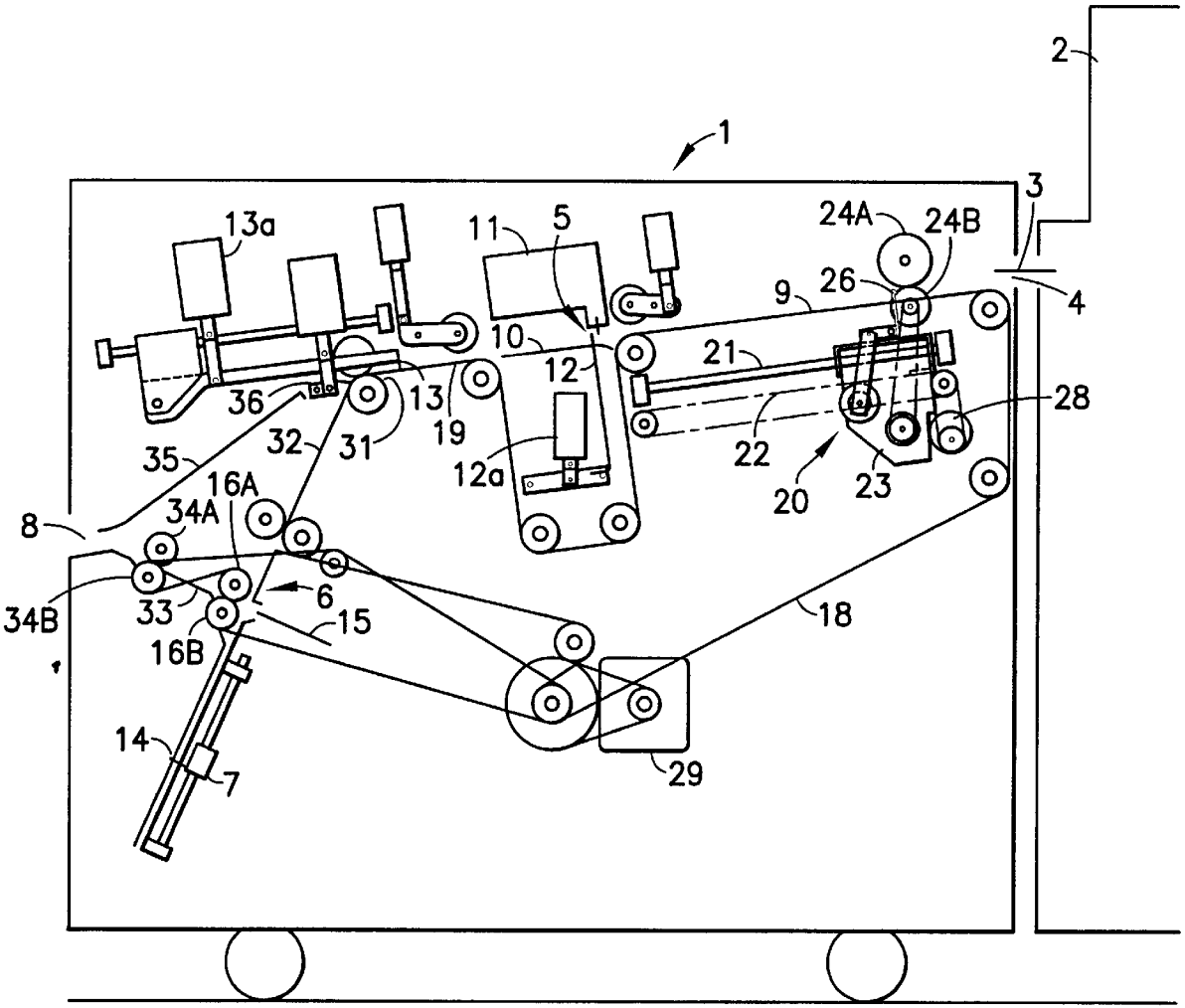
FIG. 1 is a side view illustrating a whole configuration of a book binding machine in accordance with the present invention.
Figure 2:
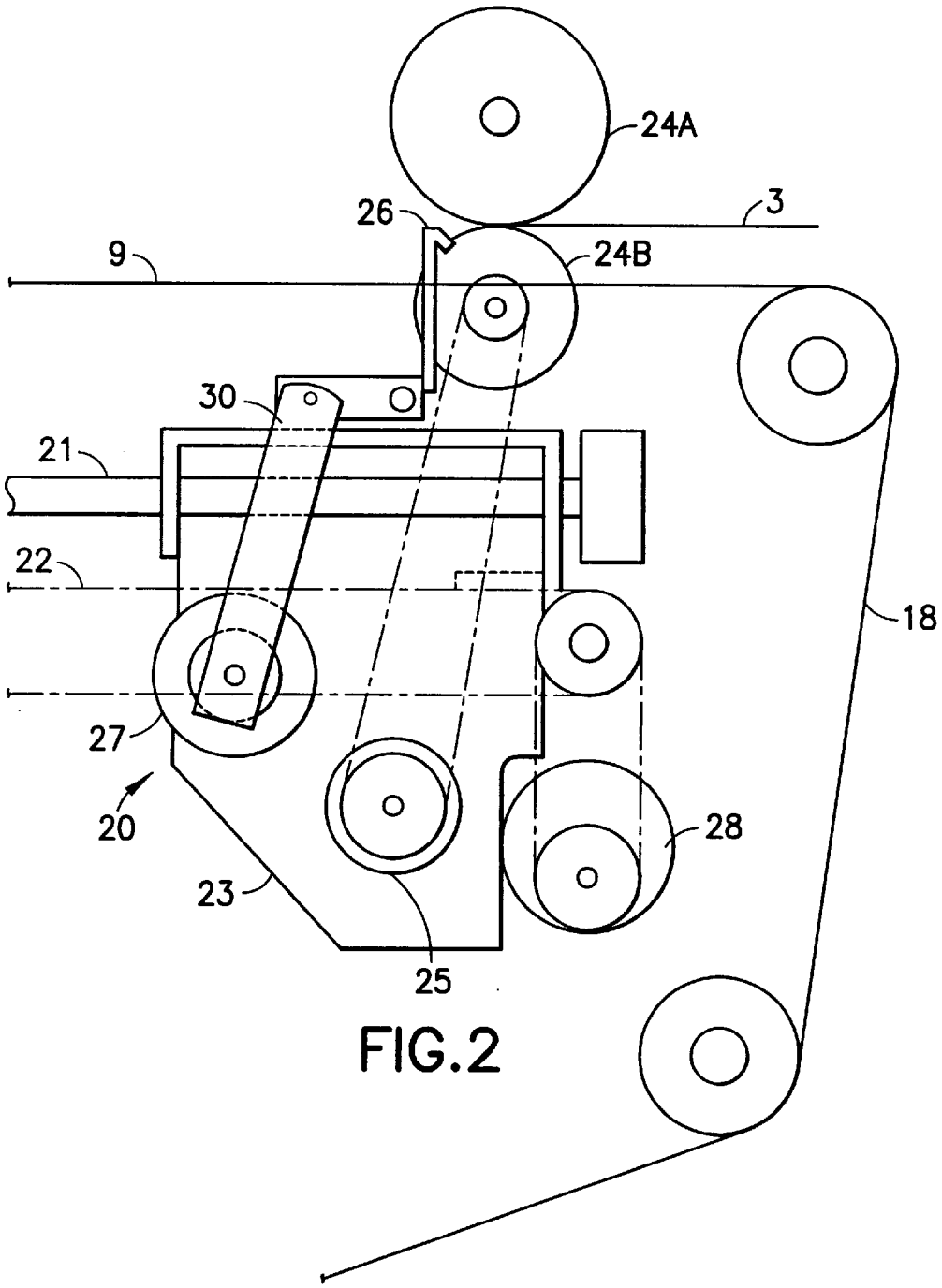
FIG. 2 is an enlarged side view illustrating a sheet gathering and registering mechanism of the book binding machine shown in FIG. 1.

FIG. 1 is a side view illustrating a whole configuration of a book binding machine in accordance with the present invention and FIG. 2 is an enlarged side view illustrating a sheet gathering and registering mechanism of the book binding machine shown in FIG. 1.

Referring to FIG. 1, a book binding machine (1) according to the invention is coupled directly to a printing machine (2) at its sheet supply inlet (4). The printing machine (2) is designed to eject sheets one by one in the order of page number, therefore the book binding machine (1) successively receives each sheet from the printing machine (2) at the sheet supply inlet (4).

The book binding machine (1) includes a sheet stitching station (5) and a sheet bending station (6) therein. In the sheet stitching station (5), a stitching head (11), a first stopper (12) disposed behind the stitching head (11) for positioning a set of sheets to be stitched along an end line or at a corner thereof, a first solenoid **(12*a*) for actuating the first stopper (12), a second stopper (13) disposed behind the stitching head (11) for positioning a set of sheets to be stitched along an center line thereof, and a second solenoid (13***a*) for actuating the second stopper (13) are installed. In the sheet bending station (6), a third stopper (7), a fold knife (15) and a pair of fold rollers (16A, 16B) are arranged.

The book binding machine (1) further includes a sheet transport path for transporting sheets from the sheet supply inlet (4) to the sheet eject outlet (8). The sheet transport path is partially constructed by a conveyor belt loop (18). Thus the sheet transport path comprises a first sheet transport path portion (9) composed of a conveyor belt loop portion extending from the sheet supply inlet (4) to the stitching head (11), a chute (10) arranged between the stitching head (11) and the first stopper (12), a second sheet transport path portion (19) composed of a conveyor belt loop portion extending from the chute (10), beyond the second stopper (13), to a branch (31), a third sheet transport path portion (32) composed of a conveyor belt loop portion downwardly sloping from the branch (31) to the sheet bending station (6), a fourth sheet transport path portion (33) formed between a pair of fold rollers (16A, 16B) and a pair of delivery rollers (34A, 34B), and an inclined guide plate (35) extending from the branch (31) to the sheet eject outlet (8). At the branch (31), a switching gate plate (36) is arranged.

The conveyor belt loop (18), which forms the first, second and third sheet transport path portions (9), (19) and (32), is driven by a motor (29).

The sheet transport path substantially linearly extends from the sheet supply inlet (4) to the branch (31), and, at the branch (31), is divided into two transport paths which slope downwardly from the branch (31) at different angles, respectively. The two transport paths are connected with each other at their forward ends (through the fourth sheet transport path portion (33)). In other words, a stitched sheet set bent along its center line is transported to the sheet eject outlet (8) along one (32, 33) of the two transport paths, while a stitched sheet set not bent is transported to the sheet eject outlet (8) along the other (35) of the two transport paths.

The book binding machine (1) further includes a sheet gathering and registering mechanism (20). The sheet gathering and registering mechanism (20) comprises a guide rod (21) arranged along the first sheet transport path portion (9), an endless drive belt (endless drive chain) (22) arranged in parallel with the guide rod (21), a motor (28) for driving the drive belt (22), and a base plate (23) fixed to the drive belt (22) and movably mounted on the guide rod (21) in such a manner that drive of the drive belt (22) effects sliding movement of the base plate (23) along the guide rod (21). The base plate (23) is provided with a first motor (25), a pair of sheet feed rollers (24A, 24B) arranged above the first sheet transport path portion (9) and driven by the first motor (25), a second motor (27), and a guide plate (26) connected to the second motor (27) through a connecting link (30). As shown in FIG. 2, the connecting link (30) is eccentrically coupled to the rotation axis of the second motor (27) at its one end and the guide plate (26) is connected to the other end of the connecting link (30), so that drive of the second motor (27) causes the guide plate (26) to make swing motion.

In the book binding machine of the present invention, on stitching a set of sheets along an end line or at a corner thereof, the first stopper (12) is actuated by the first solenoid (12*a*) so as to protrude its front end onto the sheet transport path, on the other hand, on stitching a set of sheets along an center line thereof, the second stopper (13) is actuated by the second solenoid (13*a*) so as to protrude its front end toward the stitching head (11) along the sheet transport path. The drive belt (22) is driven by the motor (28) and the base plate (23) is moved along the guide rod (21) relative to the actuated stopper (one of the first and second stopper (12;13)), for example, the first stopper (12), so that the distance between the first stopper (12) and the sheet feed rollers (24A, 24B) can be adjusted according to the size of the sheet (3) to be supplied to the sheet supply inlet (4).

Sheets (3) are supplied one by one in the order of page number to the sheet supply inlet (4) from the printing machine (2). At the same time, each sheet (3) is successively nipped between the sheet feed rollers (24A, 24B) and supplied onto the first sheet transport path portion (9), which forms a part of the sheet stitching station (5), so that the sheets (3) are laid one above another in the sheet stitching station (5). Each time the sheet is supplied to the sheet stitching station (5), the guide plate (23) makes swing motion so as to push the rear end of the top sheet (3) toward the first stopper (12) until the front end of the top sheet (3) abuts against the first stopper (12). At this time, it should be noted that the conveyor belt loop (18) is not driven. Consequently, the gathered sheets are positioned with alignment of the front and rear ends thereof in the sheet stitching station (5). Then the gathered sheets are stitched together by the stitching head (11). After stitching operation, the first stopper (12) is retracted from the sheet transport path and the conveyor belt loop (18) is driven and the stitched sheets are transported from the sheet stitching station (5) to the branch (31).

According to the present invention, since a sheet gathering and registering mechanism is built in a book binding machine, the book binding machine can be directly coupled to a printing machine without an extra space for a sheet gathering machine arranged between the book binding machine and the printing machine.

While the presently preferred embodiments of the present invention have been shown and described, it is to be understood these disclosures are for the purpose of illustration and that various changes and modifications may be made without departing from the scope of the invention as set forth in the appended claims.

What is claimed is:

1. A book binding machine having:

(a) a sheet supply inlet for receiving sheets one by one;

(b) a sheet stitching station;

(c) a sheet eject outlet for ejecting stitched sheet;

(d) a sheet transport path for transporting sheets from said sheet supply inlet to said sheet eject outlet;

(e) a stitching head arranged at said sheet stitching station;

(f) a stopper disposed downstream of said stitching head in said sheet stitching station for putting sheets in position; and (g) a sheet gathering and registering mechanism comprising a slide guide arranged along a portion of said sheet path extending from said sheet supply inlet to said sheet stitching station, a base plate mounted on said slide guide for sliding movement, a drive means for moving said base plate, a pair of sheet feed rollers arranged above said portion of said sheet transport path and attached to said base plate for successively feeding sheets from said sheet supply inlet into said sheet stitching station so as to lay the sheets one above another in said sheet stitching station: and a guide plate attached to said base plate for swaying movement in such a manner that said guide plate pushes a rear end of a top sheet toward said stopper until a front end of the top sheet abuts against said stopper each time the sheet is supplied to said sheet stitching station, said sheet gathering and registering mechanism is arranged for successively supplying the sheets from said sheet supply inlet to said sheet stitching station so as to lay the sheets one above another in said sheet stitching station and pushing the rear end of the top sheet toward said stopper until the front end of the top sheet abuts against said stopper each time the sheet is supplied to said sheet stitching station, whereby the gathered sheets are positioned with alignment of the front and rear ends thereof in said sheet stitching station.

2. The book binding machine according to claim 1, wherein:

(a) said slide guide comprises a guide rod arranged along said portion of said sheet transport path;

(b) said drive means for moving said base plate includes an endless drive belt arranged in parallel with said guide rod and a motor for driving said drive belt; and (c) said base plate is fixed to said drive belt so as to slide along said guide rod with drive of said drive belt, and that said base plate is provided with a first motor for driving said sheet feed rollers a second motor, a connecting link eccentrically coupled to the rotation axis of said second motor at its one end, said guide plate being connected to the other end of said connecting link, whereby drive of said second motor effects the swaying movement of said guide plate.

3. The book binding machine according to claim 1, wherein said slide guide comprises a guide rod arranged along said portion of said sheet transport path.

4. The book binding machine according to claim 3, wherein said drive means for moving said base plate comprises an endless drive belt arranged in parallel with said guide rod and a motor for driving said drive belt.

5. The book binding machine according to claim 4, wherein said base plate is fixed to said drive belt.

6. The book binding machine according to claim 5, wherein said base plate is provided with a first motor for driving said sheet feed rollers, a second motor, a connecting link eccentrically coupled to the rotation axis of said second motor at its one end, said guide plate being connected to the other end of said connecting link, whereby drive of said second motor effects the swaying movement of said guide plate.

* * * * *